US005816570A

United States Patent [19]

Paradis et al.

[11] Patent Number: 5,816,570

[45] Date of Patent: Oct. 6, 1998

[54] APPARATUS FOR BUFFERING THE TRANSPORT OF DOCUMENTS

[75] Inventors: Jason P. Paradis, West Haven; Steven A. Supron, Prospect, both of Conn.

[73] Assignee: Pitney Bowes Inc., Stamford, Conn.

[21] Appl. No.: 770,103

[22] Filed: Dec. 19, 1996

[51] Int. Cl.[6] ..... B65H 29/42

[52] U.S. Cl. ..... 271/179; 271/184; 198/663

[58] Field of Search ..... 271/225, 179, 271/184; 198/625, 663; 221/75

[56] References Cited

U.S. PATENT DOCUMENTS

| | | | |
|---|---|---|---|
| 1,107,556 | 8/1914 | Turok . | |
| 2,048,870 | 7/1936 | Kannee | 198/213 |
| 2,795,702 | 8/1957 | Morris | 250/66 |
| 2,970,836 | 2/1961 | Smith | 271/179 |
| 3,280,679 | 10/1966 | Huffman | 83/79 |
| 3,628,788 | 12/1971 | Simmons | 271/179 |
| 3,995,851 | 12/1976 | Casper | 271/179 |
| 4,058,908 | 11/1977 | Weber | 37/149 |
| 4,270,747 | 6/1981 | Templeton et al. | 271/179 |
| 4,547,114 | 10/1985 | Watrous et al. | 414/81 |
| 5,236,300 | 8/1993 | Aida et al. | 198/625 |
| 5,409,206 | 4/1995 | Marzullo et al. | 271/179 |
| 5,429,349 | 7/1995 | Supron et al. | 198/663 |
| 5,547,182 | 8/1996 | Murphy, III | 271/179 |

FOREIGN PATENT DOCUMENTS

| | | | |
|---|---|---|---|
| 541896 | 6/1957 | Canada | 271/84 |
| 5358635 | 1/1980 | Japan . | |
| 357067451 | 4/1982 | Japan | 271/179 |
| 62-189936 | 2/1989 | Japan | 29/42 |

*Primary Examiner*—H. Grant Skaggs
*Attorney, Agent, or Firm*—Ronald Reichman; Melvin J. Scolnick

[57] ABSTRACT

The apparatus of this invention is a buffering device for the transport of documents that comprises four variable pitch screws that have a tapered outside diameter and a tapered root diameter at the input portion of the screw. A upstream screw and a downstream screw are on the left hand side of the buffering device and a upstream screw and a downstream screw are on the right hand side of the buffering device. The upstream screw has its largest outside diameter on the top of the screw and its smallest outside diameter on the bottom of the screw. The downstream screw has its largest outside diameter on the bottom of the screw and its smallest outside diameter on the top of the screw. The screws on the left hand side of the buffering device have a left handed screw thread and the screws on the right side of the buffering device have a right handed screw thread, or visa versa.

20 Claims, 2 Drawing Sheets

APPARATUS FOR BUFFERING THE TRANSPORT OF DOCUMENTS

FIELD OF THE INVENTION

The invention relates generally to the field of buffering documents and more particularly to an apparatus for buffering the transport of documents coated with liquid ink using variable pitch helical screw conveyers.

BACKGROUND OF THE INVENTION

For increasing the throughput of mailing machines and other printing devices, it is important to provide means for the buffering transport of inked documents exiting a liquid printer, such as an ink jet printer, so that the ink is relatively dry upon the document and will not smear. The foregoing presents a problem of storing documents during the drying period without leading to stoppages in the operation of the transport and in turn halting the operation of the entire mailing machine or other device. The prior art extended the document travel path to enable sufficient drying time prior to further manipulation of the document. Machines for drying articles, such as printed material, have often used a long, substantially horizontal, conveyor belt on which articles to be dried are placed. A disadvantage of this type of machine is that, since the machine is longitudinally oriented, the extension of the travel path of the document utilizes valuable space and consumes additional time.

The prior art overcame the foregoing disadvantage by providing an apparatus that had a plurality of opposite, parallel, threaded conical screw conveyers. As the screw conveyers rotated the document was transported downward. The conical shape of the screw thread of the screw conveyers maintained the document in a substantially central position. An eject mechanism was used to push the document away from the bottom of the screw conveyers.

Some of the helical screws that were used in prior art screw conveyers had a constant outside diameter and a constant pitch. Four helical screws were used. Each screw held a portion of the document. A document would enter the top thread and move down a screw thread each time the helical screws were rotated.

A problem with the foregoing design was that sometimes an envelope flap would catch on a screw thread and cause the screw conveyer to jam.

An additional problem was that the constant screw thread pitch caused the edges of the envelope to miss a thread or catch a thread, which may cause a jam.

A further problem was that the constant outside diameter of the screw thread was not wide enough to properly support the envelopes, which increased the tendency for the envelopes to jam.

Another problem was encountered when a curl existed in an envelope. The curl made the envelope more susceptible of engaging an improper thread, which increased the probability of jamming.

The positioning of the helical screws was responsible for causing slightly oversize envelopes to buckle. The reason for the above was that the envelope did not have enough room.

The positioning of the helical screws was also responsible for causing slightly undersize envelopes to have large center line deviations, which were responsible for causing downstream insertion problems. The constant root diameter of the helical screws was responsible for causing the helical screws to be sensitive to center line deviations of incoming envelopes.

SUMMARY OF THE INVENTION

The apparatus of this invention is a buffering device for the transport of documents that comprises four variable pitch screws that have a tapered outside diameter and a tapered root diameter at the input portion of the screw. An upstream screw and a downstream screw are on the left hand side of the buffering device and a upstream screw and a downstream screw are on the right hand side of the buffering device. The upstream screw has its largest outside diameter on the top of the screw and its smallest outside diameter on the bottom of the screw. The downstream screw has its largest outside diameter on the bottom of the screw and its smallest outside diameter on the top of the screw. The screws on the left hand side of the buffering device have a left handed screw thread and the screws on the right side of the buffering device have a right handed screw thread, or visa versa. The upstream left handed screw and the downstream left handed screw are adjacent each other and for the majority of the screw there is a constant clearance between the threads of the upstream left screw and downstream left screw. The upstream right handed screw and the downstream right handed screw are adjacent each other and for the majority of the screw there is a constant clearance between the threads of the upstream right screw and downstream right screw. A secondary screw thread and a cam may be placed at the bottom of the screws. The above cam is used to aid in the centering of material. These cams are timed so that they engage documents when the lead and trail edges of the document are well constrained.

One of the advantages of this invention is that the variable pitch of the screws provides a large input area at the top of the screws which reduces the number of times documents will catch on the incorrect screw thread or collide with the thread or collide with the thread. Thus, the flaps of envelopes are less likely to engage the side of a screw thread. Since, the large input area causes the entire envelope to land on the top most thread, it does not allow the envelope the opportunity to engage the next or subsequent thread. The subsequent threads are placed closer together to allow more documents to be stacked.

Another advantage of this invention is that the large pitch on the bottom of the screw allows for additional document clearance between the ejection mechanism and the following document. The large pitch at the bottom of the screw also provides support for the document during the ejection of the document.

An additional advantage of this invention is that the secondary thread at the bottom of the screws may be used to control the document during its final descent and to supply additional support for the document.

The tapered root diameter at the top portion of the screws provides rough centering of the documents and makes the buffering device less sensitive to center line deviations during document input. The constant root diameter at the transport portion of the screws provides smooth transport of documents. The ejection portion of the screws has a cam which helps to center the documents.

DETAILED DESCRIPTION OF THE PREFERRED EMBODIMENT

Figure 1:
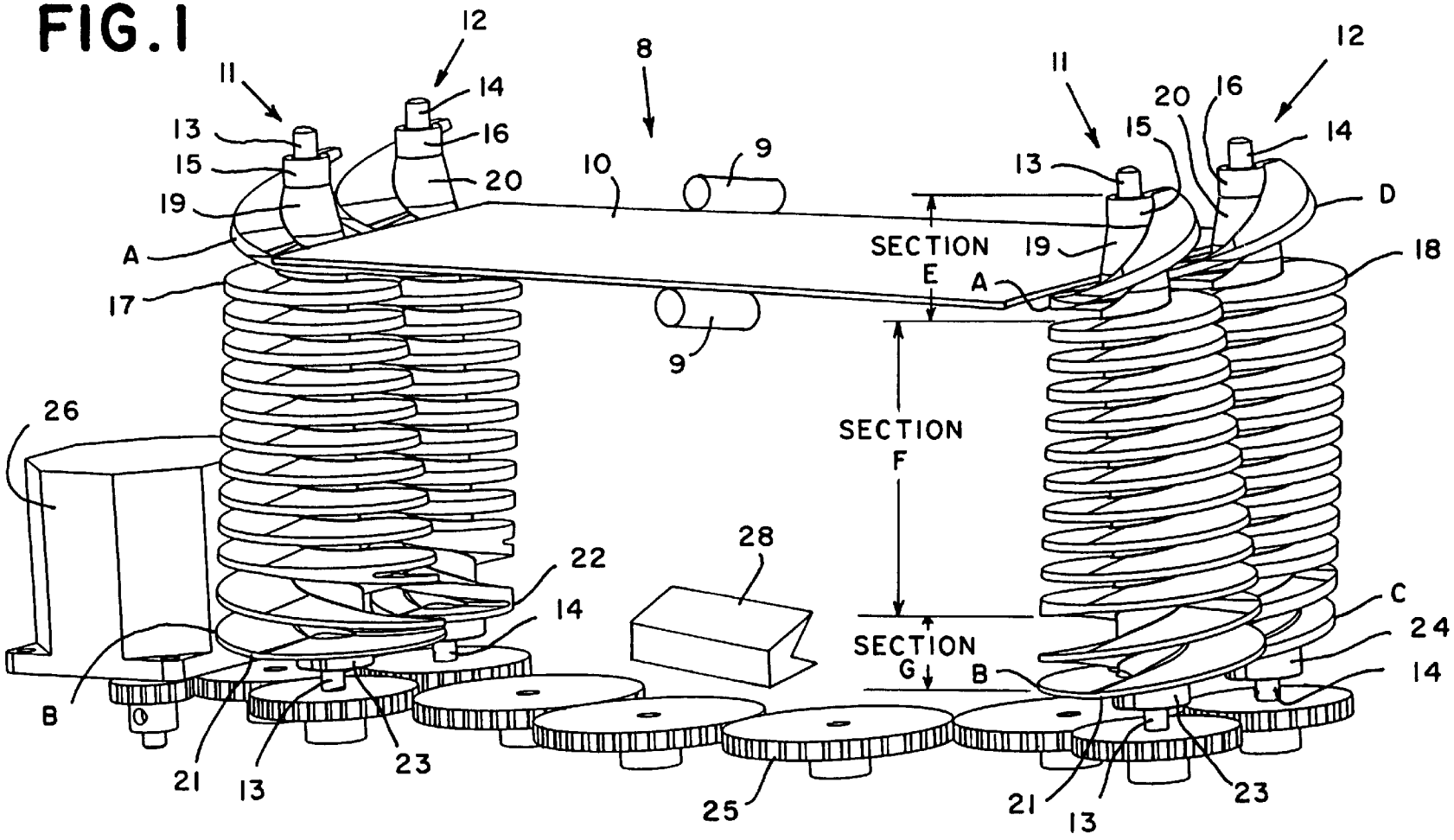
FIG. 1 is a perspective drawing of the apparatus of this invention.

Referring now to the drawing in detail and more particularly to FIG. 1, the reference character 8 represents an apparatus suitable for buffering the transport of a series of documents 10, such as those coming from a printer (not shown). The printer is a conventional stand-alone device. The printer includes conventional printing structure, such as any conventional thermal, ink jet, or other commercially available printing apparatus. In addition the printer includes a conventional feeding structure. The feeding structure may be any conventional roller-type structure for engaging and feeding document 10, including rollers 9 for feeding document 10 from the printer to upstream screws 11 and downstream screws 12. An upstream screw 11 and a downstream screw 12 are on the left hand side of buffering device 8 and a upstream screw 11 and a downstream screw 12 are on the right hand side of buffering device 8. Screws 11 have a shaft 13 attached to the screw and screws 12 have a shaft 14 attached to the screws. A tapered material 15 is attached to the top of screws 11 to provide guidance and/or clearance and a tapered material 16 is attached to the top of screws 12 to provide guidance and/or clearance. Upstream screws 11 has its largest outside diameter on the top of the screw at point A and its smallest outside diameter on the bottom of screws 11 at point B. Downstream screws 12 has its largest outside diameter on the bottom of screws 12 at point C and its smallest outside diameter on the top of the screw at point D. The screws on the left hand side of the buffering device have a left handed screw thread and the screws on the right side of the buffering device have a right handed screw thread, or visa versa. Upstream left handed screw 11 and downstream left handed screw 12 are adjacent each other and there is approximately 2 mm clearance between threads 17 of upstream left screw 11 and threads 18 of downstream left screw 12. Upstream right handed screw 11 and downstream right handed screw 12 are adjacent each other and there is approximately 2 mm clearance between threads 17 of upstream right screw 11 and threads 18 of downstream right screw 12. Screws 11 have a root diameter 19 and screws 12 have a root diameter 20.

Section E of screws 11 and 12 is an area of variable section pitch and an area of variable root diameter. The section pitch is approximately 2.5 cm vertical travel per 360° of rotation and the root diameter is between 12 mm and 18 mm. Section F of screws 11 and 12 is the area of the screws in which the documents are transported. Section F has a pitch of approximately 8 mm of vertical travel per 360° of rotation. Secondary threads 21 and 22 permit documents to leave Section G in a controlled manner. Cams 23 and 24 provide additional centering for documents. Section G of screws 11 and 12 is the area in which documents 27 are ejected. Section G has a constant root diameter and a variable pitch. The root diameter in section G is approximately 18 mm and the pitch in section G is approximately 2 cm of vertical travel for 360° of rotation.

Secondary screw thread 21 is connected to thread 17 and secondary screw 22 is connected to thread 18. Secondary threads 21 and 22 allow for the envelopes to be lowered rapidly on the final revolution of the screw for that envelope. Pusher 28 is used to eject documents as the documents reach the bottom of section G. This gives the ejection mechanism greater clearance to the following envelope to prevent jamming. A cam 23 is placed at the bottom of screws 11 and a cam 24 is placed at the bottom of screws 12 to help the alignment of undersized envelopes; i.e. those envelopes that are under tolerance. Drive shaft 25 screws 11 and 12. Drive shaft 25 is also connected to motor 26. Motor 26 and drive shaft 25 cause screws 11 and 12 to rotate so that document 10 shown at the top of screws 11 and 12 will move down the threads of screws 11 and 12 when screws 11 and 12 rotate. A different document 10 may rest on each screw thread.

Figure 2:
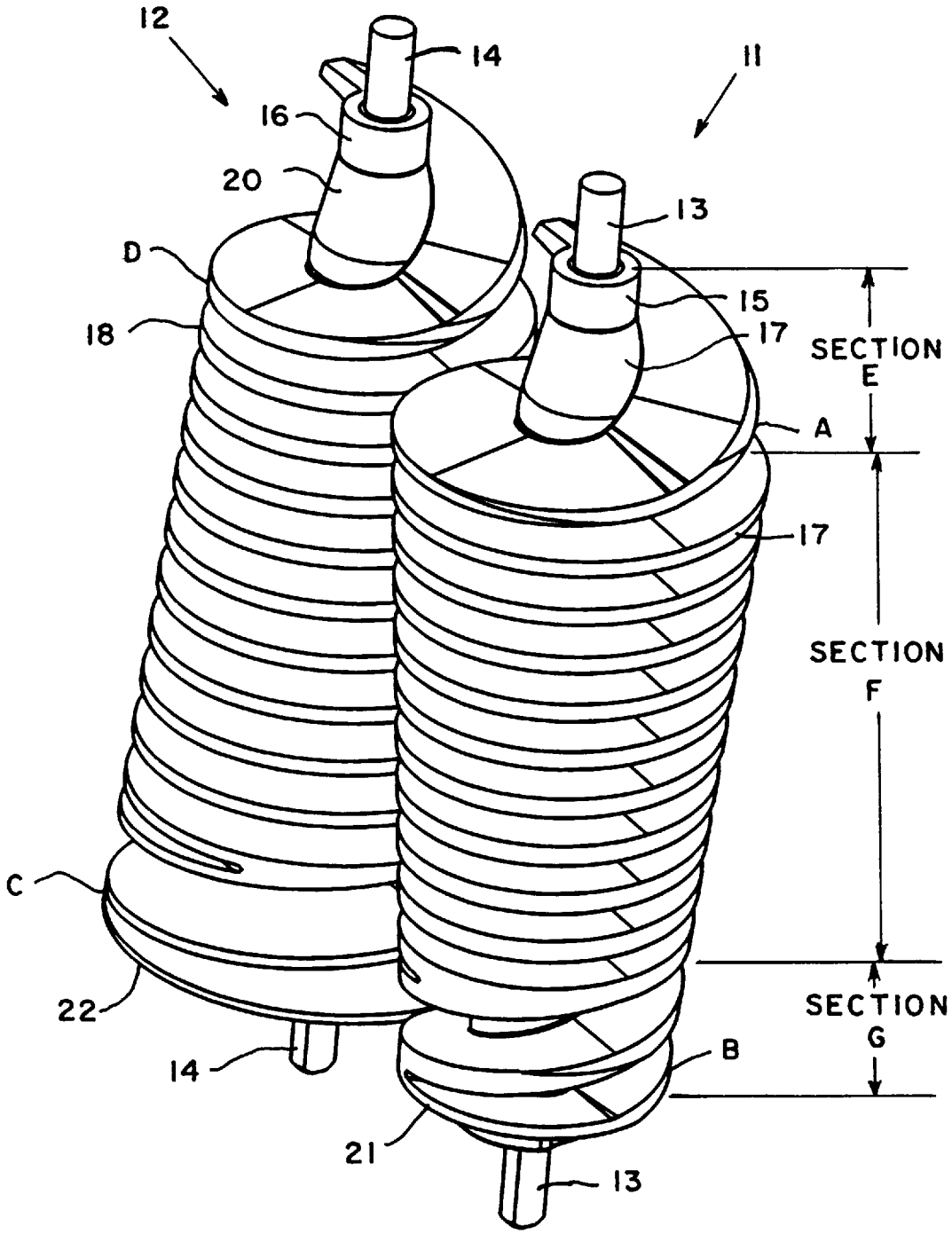
FIG. 2 is a enlarged perspective drawing of screws 11 and 12 of FIG. 1.

FIG. 2 is a enlarged perspective drawing of screws 11 and 12 of FIG. 1.

The above specification describes a new and improved buffering device that transports documents. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for buffering the transport of documents of the type in which document are transported to the top of the apparatus, the apparatus comprising:

a first upstream screw for feeding the document, said screw has a large outside diameter near the top of the screw and a small outside diameter near the bottom of the screw;

a first downstream screw for feeding the document, said downstream screw is adjacent to said first upstream screw and has a large outside diameter near the bottom of said downstream screw and a small outside diameter near the top of the screw;

a second upstream screw for feeding the document, said second upstream screw is parallel said first upstream screw, said second upstream screw has a large outside diameter at the top of said screw and a small outside diameter at the bottom of the screw;

a second downstream screw for feeding the document, said downstream screw is adjacent to said second upstream screw and has a large outside diameter at the bottom of the screw and a small outside diameter at the top of said screw; and means coupled to said first and second upstream screws and said first and second downstream screws for rotating in synchronization said screws so that the document will move from the top of said screws to the bottom of said screws.

2. The apparatus claimed in claim 1, wherein said first and second upstream screws and said first and second downstream screws have variable pitch.

3. The apparatus claimed in claim 1, wherein said first and second upstream screws and said first and second downstream screws have a variable root diameter.

4. The apparatus claimed in claim 1, wherein said first and second upstream screws and said first and second downstream screws have a variable outside diameter.

5. The apparatus claimed in claim 1, wherein said first and second upstream screws and said first and second downstream screws have a course pitch at the top of said screws to allow a large opening for the document to enter the threads of said screws.

6. The apparatus claimed in claim 1, wherein said first and second upstream screws and said first and second downstream screws have a second thread that is connected to the bottom of the threads of said screws to provide control and support of the document, said bottom threads provide a increased distance between the ejecting document and the next document.

7. The apparatus claimed in claim 1, wherein said means comprises:

a drive shaft coupled to said first and second upstream screws and said first and second downstream screws; and a motor coupled to said drive shaft.

8. The apparatus claimed in claim 1, further including means for ejecting the document from the bottom of said first and second upstream screws and said first and second down stream screws.

9. The apparatus claimed in claim 8 wherein said ejecting means is a pusher.

10. An apparatus for buffering the transport of documents of the type in which documents are transported to the top of the apparatus, the apparatus comprising:

a plurality of opposite, parallel, threaded screw conveyers orthogonal to the top of the apparatus, that hold documents in the threads of said screws, said opposite conveyers have a large outside diameter orthogonal to the top of said apparatus and a small outside diameter orthogonal to the bottom of said apparatus; and means coupled to said conveyers for rotating said conveyers so that the document will move from the top of said conveyers to the bottom of said conveyers.

11. The apparatus claimed in claim 10, wherein said conveyers have variable pitch.

12. The apparatus claimed in claim 10, wherein said conveyers have variable root diameter.

13. The apparatus claimed in claim 10, wherein said conveyers have variable outside diameter.

14. The apparatus claimed in claim 10, wherein said conveyers have a course pitch at the top of said conveyers to enable the entering document to come in contact with the threads of said conveyers.

15. The apparatus claimed in claim 10, wherein said conveyers have a second thread that is connected to the bottom of the thread of said conveyers, said second thread provides control and support of the document.

16. The apparatus claimed in claim 10, wherein said means comprises:

a drive shaft coupled to said conveyers; and a motor coupled to said drive shaft.

17. The apparatus claimed in claim 10, further including means for ejecting the document from the bottom of said conveyers.

18. The apparatus claimed in claim 17, wherein said ejecting means is a pusher.

19. The apparatus claimed in claim 18 further including a cam on the base of said opposing parallel screws that provides alignment for undersized documents.

20. The apparatus claimed in claim 10, wherein said conveyers original threads has a course pitch at the bottom of the thread to increase the distance between the ejecting document and the next document.

* * * * *